US011634291B2

(12) United States Patent
Fukumoto et al.

(10) Patent No.: US 11,634,291 B2
(45) Date of Patent: Apr. 25, 2023

(54) BELT CONVEYANCE DEVICE, SHEET FEEDING DEVICE, IMAGE FORMING APPARATUS, AND IMAGE FORMING SYSTEM

(71) Applicant: RICOH COMPANY, LTD., Tokyo (JP)

(72) Inventors: Takashi Fukumoto, Kanagawa (JP); Kenji Hayasaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 294 days.

(21) Appl. No.: 17/032,792

(22) Filed: Sep. 25, 2020

(65) Prior Publication Data

US 2021/0094778 A1 Apr. 1, 2021

(30) Foreign Application Priority Data

Sep. 27, 2019 (JP) ..... JP2019-178007
Sep. 11, 2020 (JP) ..... JP2020-153086

(51) Int. Cl.
*B65H 5/22* (2006.01)
*B65H 3/14* (2006.01)
(Continued)

(52) U.S. Cl.
CPC ..... *B65H 5/224* (2013.01); *B65H 3/128* (2013.01); *B65H 3/14* (2013.01); *G03G 15/6529* (2013.01);
(Continued)

(58) Field of Classification Search
CPC ..... B65H 5/224; B65H 3/14; B65H 3/124; B65H 3/128; B65H 2406/31; B65H 2406/3124; B65H 2406/32; B65H 2406/321; B65H 2406/322; B65H 2406/3221; B65H 2406/3222; B65H 2406/323; B65H 2406/362; B65H 2406/363; B65H 2406/3632; G03G 15/6529
See application file for complete search history.

(56) References Cited

U.S. PATENT DOCUMENTS 8,113,515 B2 12/2012 Komiyama et al.
8,322,712 B2 12/2012 Funayanagi et al.
(Continued)

FOREIGN PATENT DOCUMENTS

CN 103922164 A 7/2014
CN 104163349 A 11/2014
(Continued)

OTHER PUBLICATIONS

Office Action dated May 13, 2022 in Chinese Patent Application No. 202011030472.3, 8 pages.
(Continued)

*Primary Examiner* — Jeremy R Severson
(74) *Attorney, Agent, or Firm* — Xsensus LLP

(57) ABSTRACT

A belt conveyance device includes an endless belt, a duct having a suction port, and a rectifier inside the duct. The duct is surrounded by an inner circumferential surface of the endless belt. The rectifier extends in a width direction of the endless belt perpendicular to a direction of conveyance by the endless belt.

11 Claims, 16 Drawing Sheets

(51) Int. Cl.
*G03G 15/00* (2006.01)
*B65H 3/12* (2006.01)

(52) U.S. Cl.
CPC .... *B65H 2406/31* (2013.01); *B65H 2406/323* (2013.01); *B65H 2406/362* (2013.01)

(56) References Cited

U.S. PATENT DOCUMENTS

| | | | | |
|---|---|---|---|---|
| 2014/0191461 | A1 | 7/2014 | Umemoto et al. | |
| 2015/0021848 | A1 | 1/2015 | Mizuno et al. | |
| 2016/0016740 | A1 | 1/2016 | Niikura et al. | |
| 2016/0107853 | A1 | 4/2016 | Hashimoto et al. | |
| 2016/0107854 | A1 | 4/2016 | Hashimoto et al. | |
| 2016/0122144 | A1* | 5/2016 | Fukumoto ..... | B65H 7/02 271/11 |
| 2016/0185552 | A1 | 6/2016 | Hoshino et al. | |
| 2016/0264370 | A1 | 9/2016 | Okutsu et al. | |
| 2017/0081140 | A1 | 3/2017 | Fukumoto et al. | |
| 2017/0160689 | A1 | 6/2017 | Sugawara et al. | |
| 2017/0327329 | A1 | 11/2017 | Takahashi et al. | |
| 2018/0237239 | A1 | 8/2018 | Okutsu et al. | |
| 2019/0152730 | A1 | 5/2019 | Hashimoto et al. | |
| 2019/0218048 | A1 | 7/2019 | Sendo | |
| 2020/0102166 | A1 | 4/2020 | Hayasaka et al. | |

FOREIGN PATENT DOCUMENTS

| | | |
|---|---|---|
| CN | 104291133 A | 1/2015 |
| JP | 2-081838 | 3/1990 |
| JP | 3-82343 U | 8/1991 |
| JP | 2005-001855 | 1/2005 |
| JP | 2019-094212 | 6/2019 |

OTHER PUBLICATIONS

Extended European Search Report dated Mar. 5, 2021 in European Patent Application No. 20198337.6, 7 pages.

* cited by examiner

COMPARATIVE EXAMPLE

COMPARATIVE EXAMPLE

COMPARATIVE EXAMPLE

COMPARATIVE EXAMPLE

BELT CONVEYANCE DEVICE, SHEET FEEDING DEVICE, IMAGE FORMING APPARATUS, AND IMAGE FORMING SYSTEM

CROSS-REFERENCE TO RELATED APPLICATIONS

This patent application is based on and claims priority pursuant to 35 U.S.C. § 119(a) to Japanese Patent Application Nos. 2019-178007, filed on Sep. 27, 2019, and 2020-153086, filed on Sep. 11, 2020 in the Japan Patent Office, the entire disclosure of each of which is hereby incorporated by reference herein.

BACKGROUND

Technical Field

Embodiments of the present disclosure relate to a belt conveyance device, a sheet feeding device, an image forming apparatus, and an image forming system.

Description of the Related Art

There is known a belt conveyance device that includes an endless belt having through holes and a duct having a suction port. The duct is disposed in a space surrounded by an inner circumferential surface of the endless belt.

SUMMARY

Embodiments of the present disclosure describe an improved belt conveyance device that includes an endless belt, a duct having a suction port, and a rectifier inside the duct. The duct is surrounded by an inner circumferential surface of the endless belt. The rectifier extends in a width direction of the endless belt perpendicular to a direction of conveyance by the endless belt.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
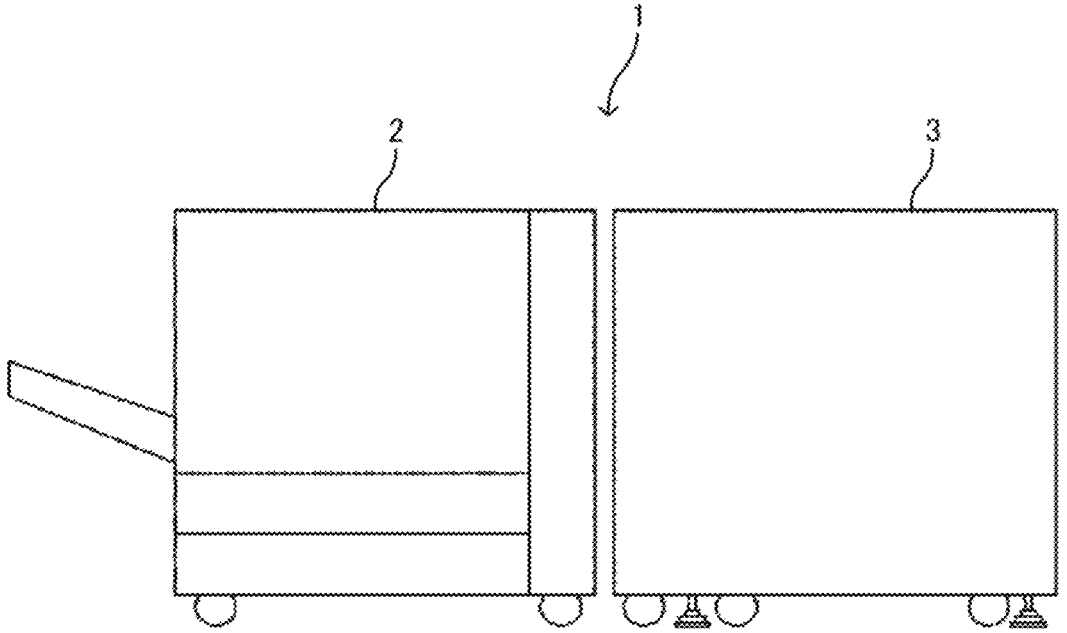
FIG. 1 is a schematic view illustrating a configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and Bk attached to each reference numeral indicate only that components indicated thereby are used for forming yellow, magenta, cyan, and black images, respectively, and hereinafter may be omitted when color discrimination is not necessary.

In a comparative example, a sheet feeding device includes a belt conveyance device including an endless belt and a duct to feed a sheet. In the sheet feeding device, a bundle of sheets is stacked on a sheet stacker. A blower blows air onto a top sheet of the bundle of sheets to levirate the top sheet. The belt conveyance device feeds the top sheet levitated by the blower. When this type of belt conveyance device is used for conveying a sheet, the suction efficiency of the duct is required to be improved in order to reliably convey various sheets having different weights or flexibilities, in particular, a sheet having heavy weight or low flexibility. To solve the above-described situation, the present disclosure has been made.

A description is given below of a sheet feeding device according to an embodiment of the present disclosure. FIG. 1 is a schematic view illustrating a configuration of an image forming system 1 according to the present embodiment. The image forming system 1 includes an image forming apparatus 2 to form an image on a sheet and a sheet feeding device 3 to feed the sheet to the image forming apparatus 2. The sheet feeding device 3 is disposed on the side of the image forming apparatus 2. Alternatively, the image forming apparatus 2 may include the sheet feeding device 3 in one united body.

Figure 2:
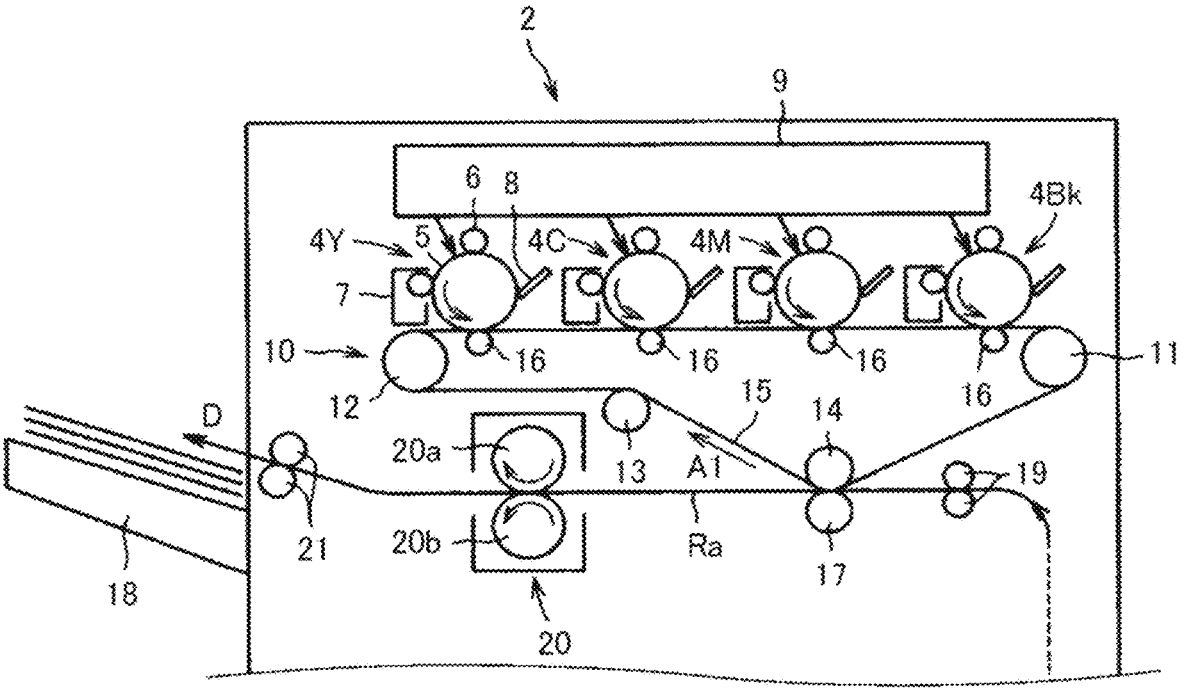
FIG. 2 is a schematic view illustrating a configuration of an electrophotographic image forming apparatus of the image forming system in FIG. 1.

The sheet feeding device 3 according to the present embodiment is applicable to an image forming apparatus employing an electrophotographic method or an inkjet method. As an example, the overall configuration and operation of the electrophotographic image forming apparatus 2 are described. FIG. 2 is a schematic view illustrating a configuration of the electrophotographic image forming apparatus 2. The image forming apparatus 2 includes four process units 4Y, 4C, 4M and 4Bk as image forming units to form an image on a sheet. The process units 4Y, 4C, 4M, and 4Bk have the same configuration except for containing different color toners, i.e., yellow (Y), magenta (M), cyan (C), and black (Bk) toners, respectively, corresponding to decomposed color components of full-color images.

Each of the process units 4Y, 4M, 4C, and 4Bk includes a photoconductor 5 as an electrostatic latent image bearer, a charging roller 6 as a charging device to charge the surface of the photoconductor 5, a developing device 7 to form a toner image on the surface of the photoconductor 5, and a cleaning blade 8 as a cleaning device to clean the surface of the photoconductor 5.

An exposure device 9 is disposed above the process units 4Y, 4C, 4M, and 4Bk. The exposure device 9 irradiates the photoconductors 5 of the process units 4Y, 4C, 4M, and 4Bk with laser beams. A transfer device 10 is disposed below the process units 4Y, 4C, 4M, and 4Bk. The transfer device 10 includes an intermediate transfer belt 15 looped around multiple rollers 11 to 14. The intermediate transfer belt 15 is an endless belt. The intermediate transfer belt 15 rotates in the direction indicated by arrow A1 illustrated in FIG. 2 as a drive roller, which is one of the multiple rollers 11 to 14, rotates.

Four primary transfer rollers 16 are disposed opposite the respective four photoconductors 5. Each primary transfer roller 16 is pressed against the corresponding photoconductor 5 via the intermediate transfer belt 15, and a nip between the intermediate transfer belt 15 and the photoconductor 5 is called a primary transfer nip. A secondary transfer roller 17 is disposed opposite the roller 14, which is one of the multiple rollers 11 to 14 around which the intermediate transfer belt 15 is looped. The contact portion between the secondary transfer roller 17 and the intermediate transfer belt 15 is called a secondary transfer nip.

A conveyance path Ra is disposed inside the image forming apparatus 2, and a sheet is supplied from the sheet feeding device 3 described above to the secondary transfer nip and guided to an output tray 18 disposed outside the apparatus body of the image forming apparatus 2 along the conveyance path Ra. Along the conveyance path Ra, a registration roller pair 19 is disposed upstream from the secondary transfer roller 17 in a direction of conveyance of the sheet indicated by arrow D in FIG. 2 (hereinafter referred to as a conveyance direction). A fixing device 20 is disposed downstream from the secondary transfer roller 17 in the conveyance direction. An output roller pair 21 is disposed downstream from the fixing device 20 in the conveyance direction. The fixing device 20 includes a heating roller 20*a* including a heat source therein and a pressure roller 20*b* that presses the heating roller 20*a*. The heating roller 20*a* and the pressure roller 20*b* are pressed against each other, and a contact portion between the heating roller 20*a* and the pressure roller 20*b* is called a fixing nip.

The basic operation of the image forming apparatus 2 is as follows. As each photoconductor 5 of the process units 4Y, 4C, 4M, and 4Bk rotates counterclockwise in FIG. 2, the charging roller 6 uniformly charges the surface of the photoconductor 5 in a predetermined polarity. Then, the exposure device 9 irradiates the charged surfaces of the respective photoconductors 5 with laser beams based on image data of documents read by a reading device. Thus, electrostatic latent images are formed on the surfaces of the respective photoconductors 5. Note that the image data for exposing the photoconductor 5 is single-color image data obtained by decomposing a desired full-color image into individual color components, that is, yellow, cyan, magenta, and black components. The electrostatic latent image thus formed on the photoconductor 5 is developed into a toner image (visible image) with toner deposited by the developing device 7.

The intermediate transfer belt 15 rotates in the direction indicated by arrow A1 illustrated in FIG. 2 as the drive roller rotates, which is one of the multiple rollers 11 to 14 around which the intermediate transfer belt 15 is looped. A power supply applies a constant voltage or a voltage controlled at a constant current, which has a polarity opposite the polarity of the charged toner, to the primary transfer rollers 16. As a result, transfer electric fields are generated at the respective primary transfer nips between the primary transfer rollers 16 and the photoconductors 5. The transfer electric fields generated at the primary transfer nips sequentially transfer and superimpose the respective toner images from the photoconductors 5 onto the intermediate transfer belt 15. Thus, a full-color toner image is formed on the surface of the intermediate transfer belt 15. After the primary transfer process, a certain amount of toner, which is not transferred to the intermediate transfer belt 15, remains on the surface of the photoconductor 5. The cleaning blade 8 removes the toner remaining on photoconductors 5.

The sheet feeding device 3 illustrated in FIG. 1 feeds the sheet to the image forming apparatus 2. A registration roller pair 19 forwards the sheet fed from the sheet feeding device 3 to the secondary transfer nip between the secondary transfer roller 17 and the intermediate transfer belt 15 at an appropriate timing. At that time, a transfer voltage opposite in polarity to the toner image on the intermediate transfer belt 15 is applied to the secondary transfer roller 17, and a transfer electric field is generated in the secondary transfer nip. The transfer electric field generated in the secondary transfer nip collectively transfers the toner images from the intermediate transfer belt 15 onto the sheet.

The sheet bearing the toner image is conveyed to the fixing device 20. In the fixing device 20, the sheet is sandwiched between the heating roller 20*a* and the pressure roller 20*b*, thereby fixing the toner image on the sheet under heat and pressure. Then, the output roller pair 21 ejects the sheet to the output tray 18.

The above description concerns the image forming operation of the color image forming apparatus 2 to form the full-color toner image on the sheet. Alternatively, the image forming apparatus 2 may form a monochrome toner image by using any one of the four process units 4Y, 4C, 4M, and 4Bk, or may form a bicolor toner image or a tricolor toner image by using two or three of the process units 4Y, 4C, 4M, and 4Bk.

Figure 3:
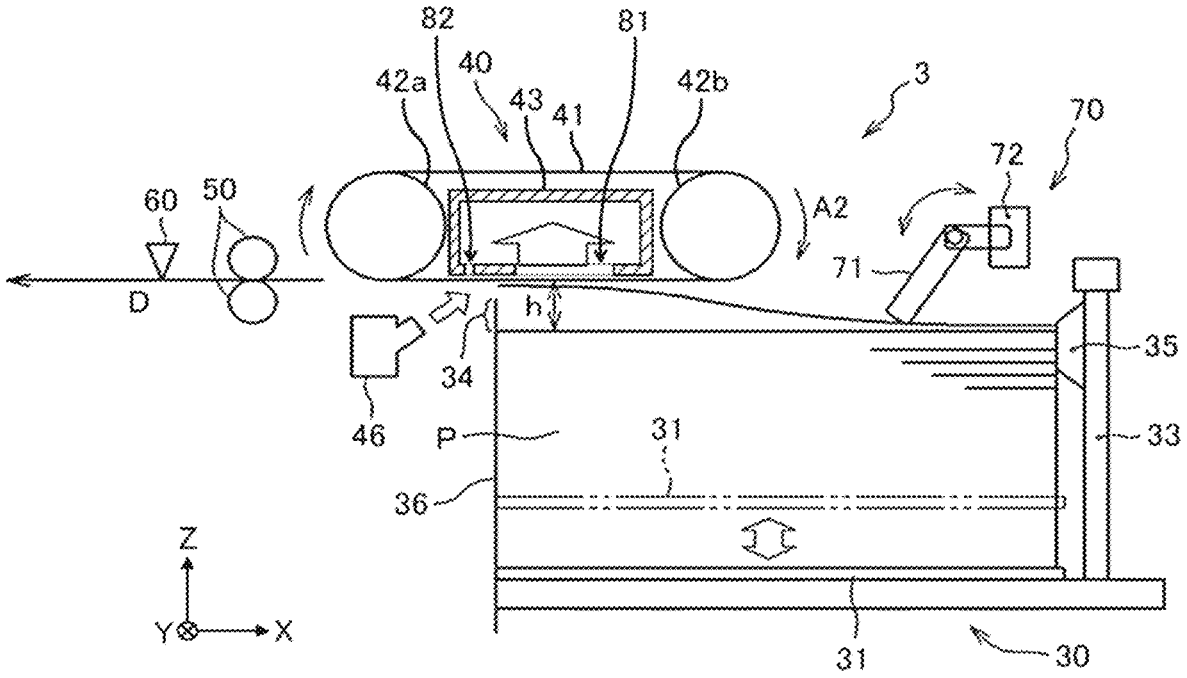
FIG. 3 is a schematic view illustrating a configuration of a sheet feeding device of the image forming system in FIG. 1.
Figure 4:
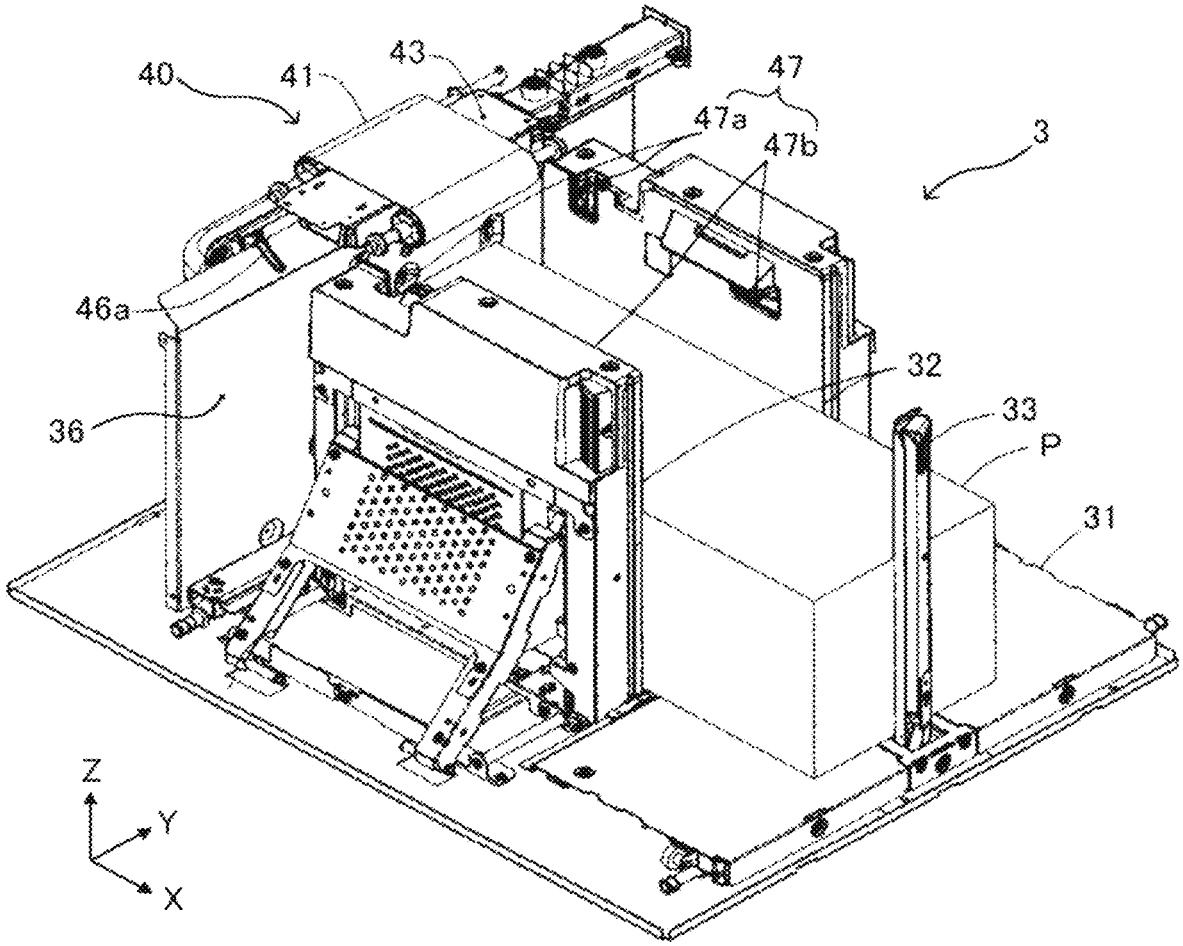
FIG. 4 is a schematic perspective view of the sheet feeding device in FIG. 3.

FIG. 3 is a schematic view illustrating a configuration of the sheet feeding device 3 according to the present embodiment. FIG. 4 is a schematic perspective view of the sheet feeding device 3. The sheet feeding device 3 includes a sheet feeding tray 30 and a suction belt unit 40. The sheet feeding tray 30 serves as a sheet stacker on which a plurality of sheets P can be stacked. The suction belt unit 40 serves as a conveyor or a belt conveyance device to feed and convey the sheet P. It is to be noted that the "sheet P" used here includes thick paper, post cards, envelopes, plain paper, thin paper, coated paper, art paper, tracing paper, and the like. Additionally, overhead projector (OHP) transparencies (OHP sheet or OHP film) can be used as a sheet-shaped recording medium.

The sheet feeding tray 30 includes a bottom plate 31, a front fence 36, a pair of side fences 32 (see FIG. 4), and an end fence 33. The front fence 36 positions the leading end of the bundle of sheets P stacked on the bottom plate 31 in the conveyance direction of the sheet P. The pair of side fences 32 positions both ends of the bundle of sheets Pin the width direction of the sheet P. The end fence 33 positions the trailing end of the bundle of sheets P in the conveyance direction. A restrictor 34 is disposed at the upper end of the front fence 36 to inhibit the sheets P other than the top sheet P (the second and subsequent sheets P from the top) from moving in the conveyance direction. The restrictor 34 is arranged so as to project above the uppermost position of the bundle of sheets P stacked in the sheet feeding tray 30. A pressing member 35 projecting from the end fence 33 toward the stacked sheets P is disposed at the upper portion of the end fence 33.

The suction belt unit 40 is disposed above the sheets P stacked in the sheet feeding tray 30. The suction belt unit 40 includes a suction belt 41 that is an endless belt having through holes. The suction belt 41 is provided with a plurality of suction ports (i.e., the through holes). A duct 43 having a suction port is surrounded by the inner circumferential surface of the suction belt 41. Air is sucked from the suction port of the duct 43 via the plurality of suction ports of the suction belt 41 to attract the sheet P on the lower surface of the suction belt 41. The suction belt 41 is stretched around a plurality of rollers 42*a* and 42*b*. As the one of the plurality of rollers 42*a* and 42*b* is driven to rotate, the suction belt 41 rotates in the direction indicated by arrow A2 in FIG. 3. A conveyance roller pair 50 is disposed downstream from the suction belt 41 to convey the sheet P, and a sheet sensor 60 is disposed downstream from the conveyance roller pair 50 to detect the sheet P conveyed by the conveyance roller pair 50 in the conveyance direction indicated by arrow D.

An upper position detector 70 is disposed above the sheet feeding tray 30 to detect the position of the upper surface of the bundle of sheets P stacked in the sheet feeding tray 30. The upper position detector 70 includes an actuator 71 and a swing sensor 72. The actuator 71 contacts the upper surface of the bundle of sheets P and is swingable according to the position of the upper surface. The swing sensor 72 detects the swing of the actuator 71. The sheet P is supplied from the bundle of sheets P, and the actuator 71 swings as the height of the bundle of sheets P decreases. The swing sensor 72 detects the amount of swing of the actuator 71, and the push-up device raises the bottom plate 31 of the sheet feeding tray 30 based on the detection signal from the swing sensor 72. Thus, the height (distance) h from the upper surface of the bundle of sheets P to the suction belt 41 is kept constant.

A front blower 46 is disposed in front of the sheet feeding tray 30 in the conveyance direction to blow air onto the sheet P stacked in the sheet feeding tray 30. The side fence 32 is provided with air outlets 47*a* and 47*b* of the side blower 47 (see FIG. 4).

Figure 5:
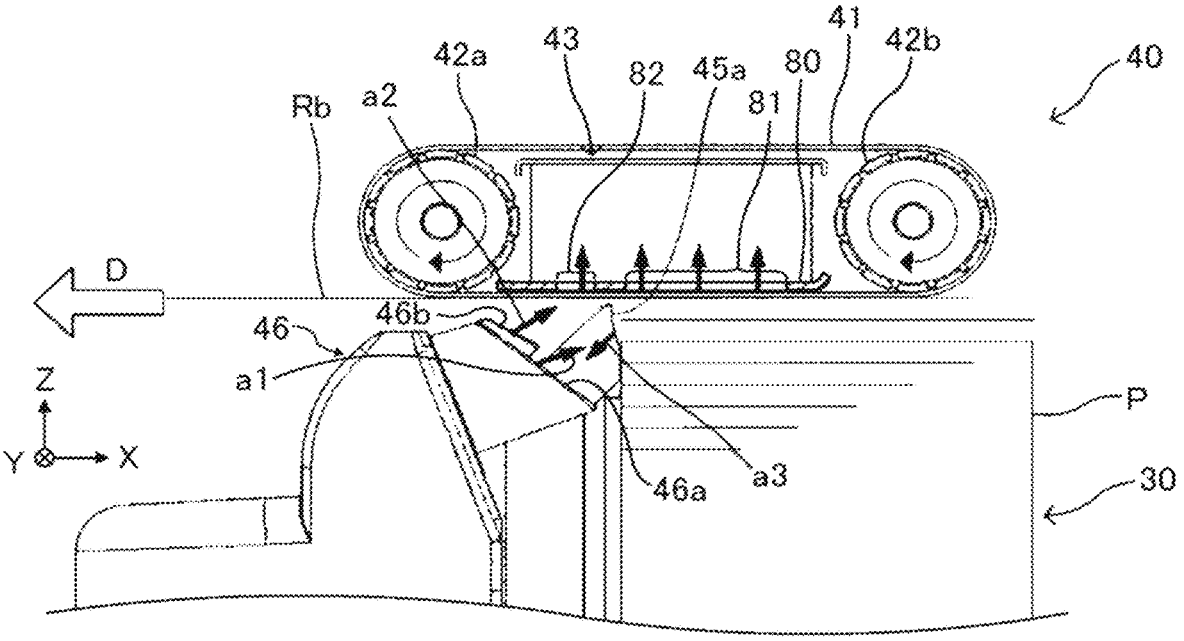
FIG. 5 is an enlarged view of a suction belt unit of the sheet feeding device and the surrounding structure.

FIG. 5 is an enlarged view of the suction belt unit 40 and the surrounding structure. The front blower 46 includes a levitation nozzle 46*a* and a separation nozzle 46*b*. The levitation nozzle 46*a* ejects levitation air al to levitate the sheet P, and the separation nozzle 46*b* ejects separation air a2 to separate the top sheet P and the second and subsequent sheets P under the top sheet P. The downward suction nozzle 45*a* is provided to generate downward suction air a3 so as to suck air in the vicinity of the front end of the upper portion of the bundle of sheets P downward. The downward suction nozzle 45*a* is coupled to a downward suction device.

Figure 8:
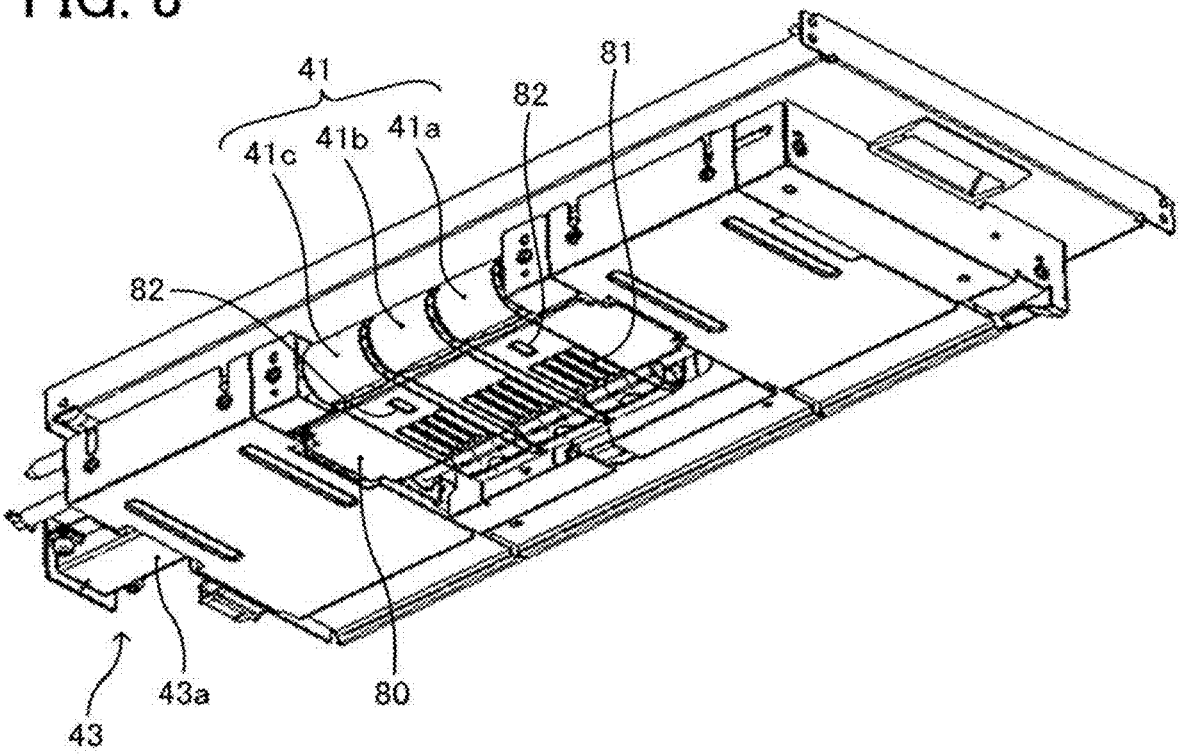
FIG. 8 is a perspective view of the suction belt unit with a suction belt depicted transparently.

As illustrated in FIG. 5, a suction port of a lower wall (exterior wall) 80 of the duct 43 includes a suction opening 81 facing the leading end of the bundle of sheets P from above, and a conveyance opening 82 facing a sheet conveyance path Rb downstream from the bundle of sheets P in the conveyance direction by the suction belt 41 (see FIG. 8).

Figure 6:
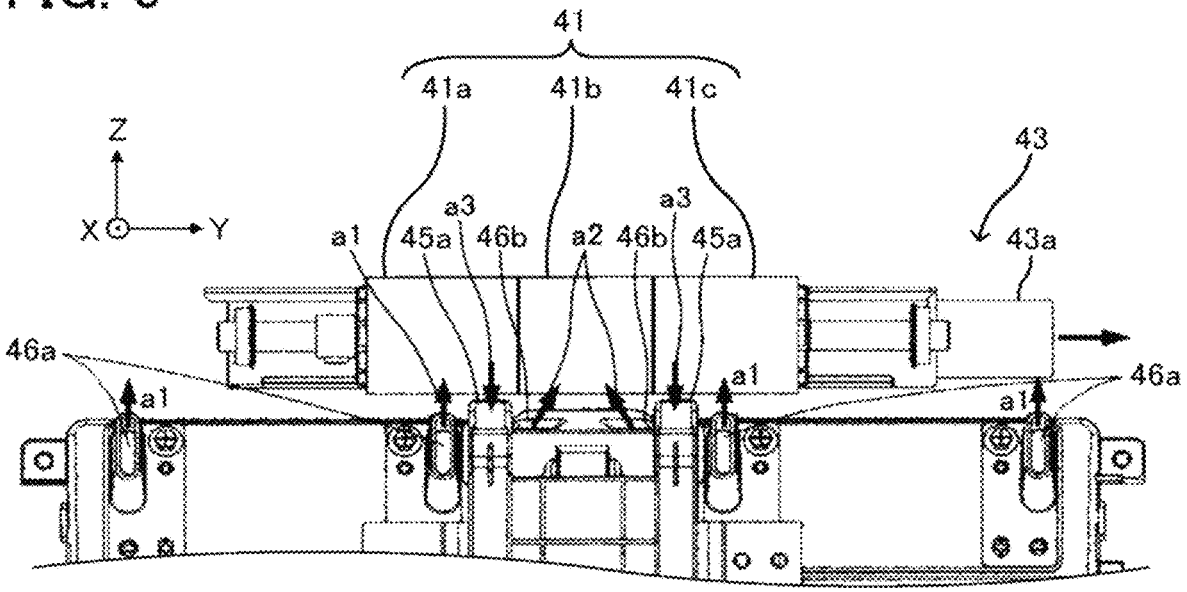
FIG. 6 is an enlarged view of the suction belt unit of the sheet feeding device and the surrounding structure.

FIG. 6 is an enlarged view of the suction belt unit 40 and the surrounding structure with the front fence 36 removed, as viewed from the sheet feeding tray 30. In the example illustrated in FIG. 6, the suction belt 41 is divided into three belts 41*a*, 41*b*, and 41*c* in the width direction of the suction belt 41, which is the same as the width direction of the sheet P. The separation nozzles 46*b* face the belt 41*b* disposed at the center portion corresponding to the center in the width direction of the sheet P. The levitation nozzles 46*a* are disposed corresponding to both end sides of the sheet P in the width direction, and the two of the levitation nozzles 46*a* face the belts 41*a* and 41*c* disposed on both sides. The downward suction nozzles 45*a* face the belts 41*a* and 41*c* disposed on both sides corresponding to both end sides of the sheet P in the width direction. The restrictor 34 (see FIG. 3) is disposed facing the downward suction nozzle 45*a*.

Figure 7:
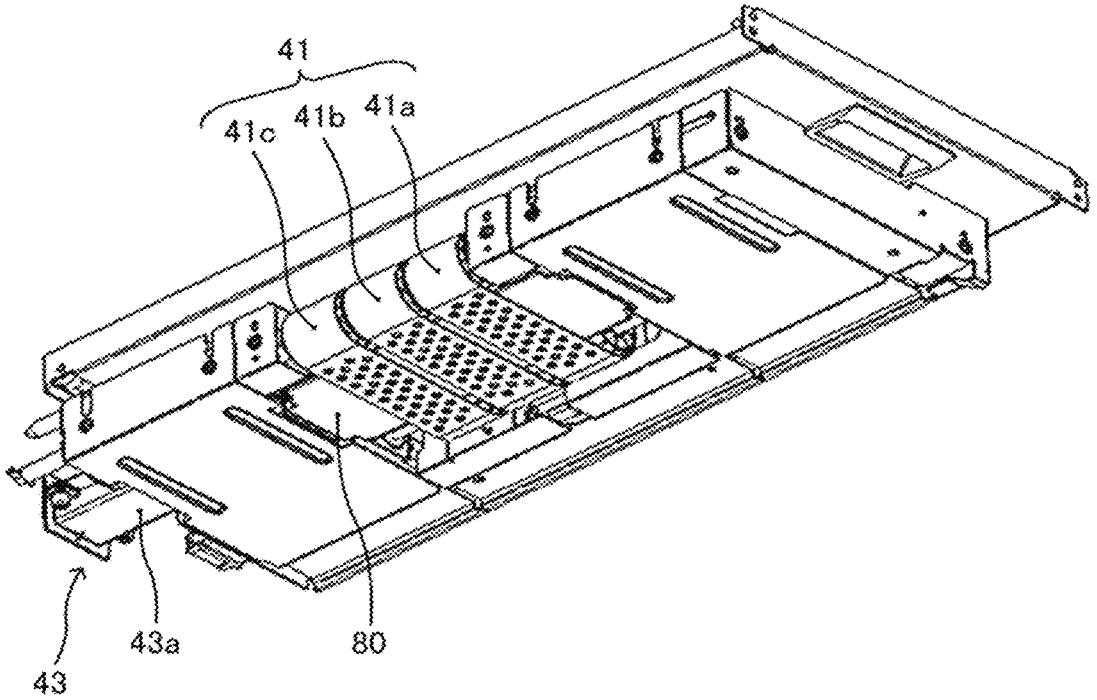
FIG. 7 is a perspective view of the suction belt unit as viewed obliquely from below.

FIG. 7 is a perspective view of the suction belt unit 40 as viewed obliquely from below. FIG. 8 is a perspective view of the suction belt unit 40 with the suction belt 41 depicted transparently so that the lower wall 80 of the duct 43 can be seen. A plurality of suction openings 81 faces each of the belts 41*a*, 41*b*, and 41*c*. The one conveyance opening 82 faces each of the belts 41*a* and 41*c* disposed on both sides. In both FIGS. 7 and 8, the plurality of suction ports (through holes) is omitted in the portion of the suction belt 41 wound around the roller 42*a*.

Figure 9:
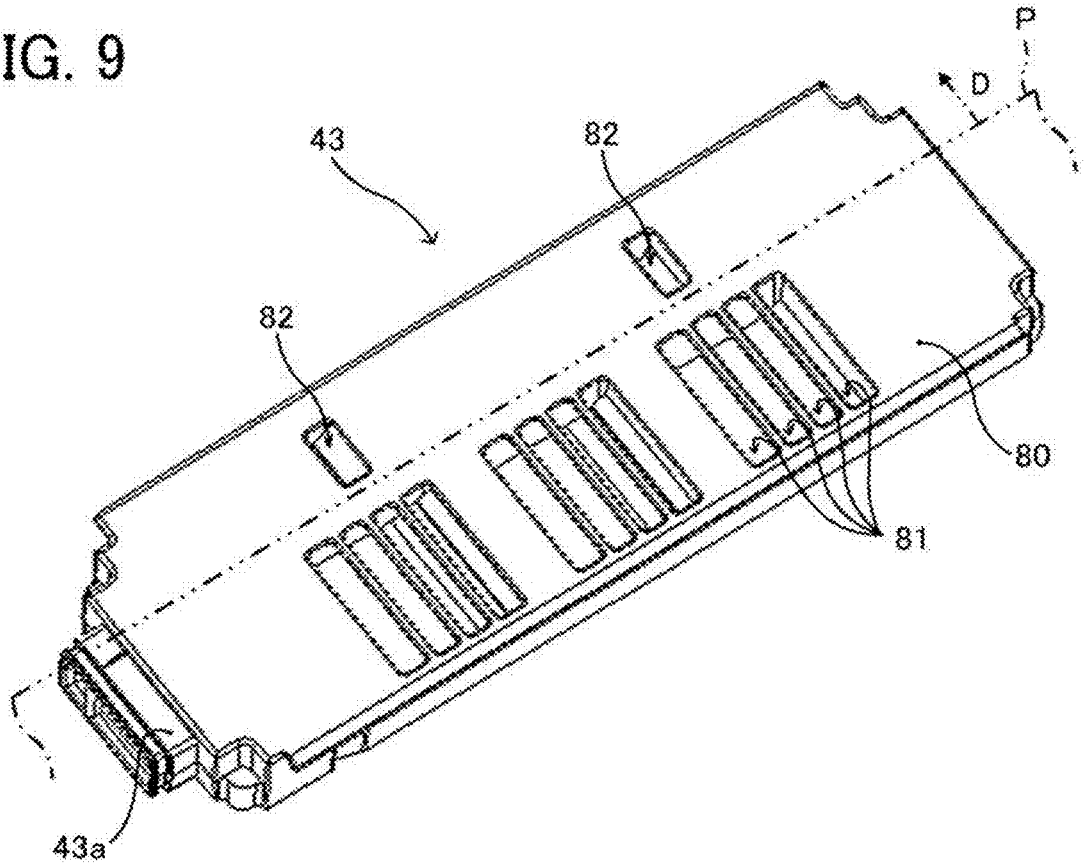
FIG. 9 is a perspective view of a duct whose lower wall is viewed from below according to an embodiment of the present disclosure.

FIG. 9 is a perspective view of the duct 43 whose lower wall 80 is viewed from below. In the example illustrated in FIG. 9, the four suction openings 81 face each of the belts 41*a*, 41*b*, and 41*c*. The suction openings 81 and the conveyance openings 82 in the lower wall 80 are disposed at the same position in the duct 43 according to both the present embodiment and a comparative example described below. The phantom line (dashed double-dotted line) indicates the sheet P on the bundle of sheets P, and arrow D indicates the conveyance direction by the suction belt 41.

The suction opening may be a single large hole but, in the present embodiment, is divided to the plurality of suction openings 81 with ribs to prevent the sheet P from deforming due to suction force, and to contact the sheet P with the surface of the suction belt 41 uniformly while the sheet P is sucked. The conveyance openings 82 are provided so as to prevent the sheet P from hanging down from the surface of the suction belt 41 when the trailing end of the sheet P passes through the suction openings 81 during conveyance of the sheet P, and to convey the sheet P while sucking the sheet P firmly.

Figure 10:
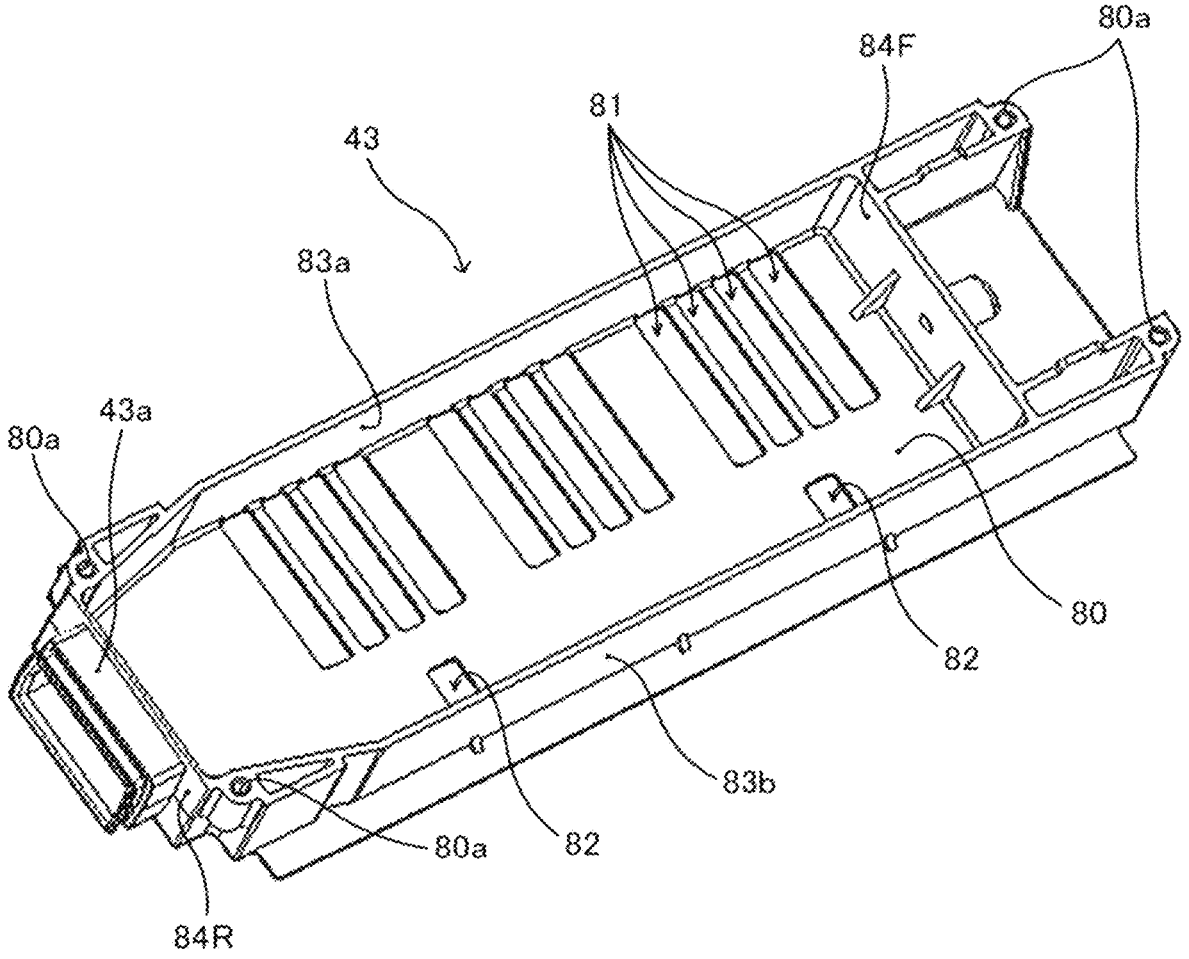
FIG. 10 is a perspective view of a duct according to a comparative example.

FIG. 10 is a perspective view of the duct 43 according to the comparative example. In FIG. 10, the duct 43 is rotated by 180 degrees from the state illustrated in FIG. 9 around the center line in the longitudinal direction so that the inner surface of the lower wall 80 of the duct 43 can be seen. An upper wall that is secured to screw holes 80*a* with screws is removed in FIG. 10. Long side walls 83*a* and 83*b* and short side walls 84F and 84R are disposed on the four sides of the periphery of the lower wall 80. The lower wall 80, the side walls 83*a*, 83*b*, 84F, and 84R, and the upper wall form an internal space having a rectangular parallelepiped shape. An exhaust port 43*a*, which is a coupling portion to connect the interior and the outside of the duct 43, is disposed on the short side wall 84R located on the rear side of the sheet feeding device 3. The width between the long side walls 83*a* and 83*b* is narrowed toward both ends of the exhaust port 43*a* in the vicinity of the exhaust port 43*a*. As a result, the internal space has a tapered shape in the vicinity of the exhaust port 43*a*.

Figure 11A:
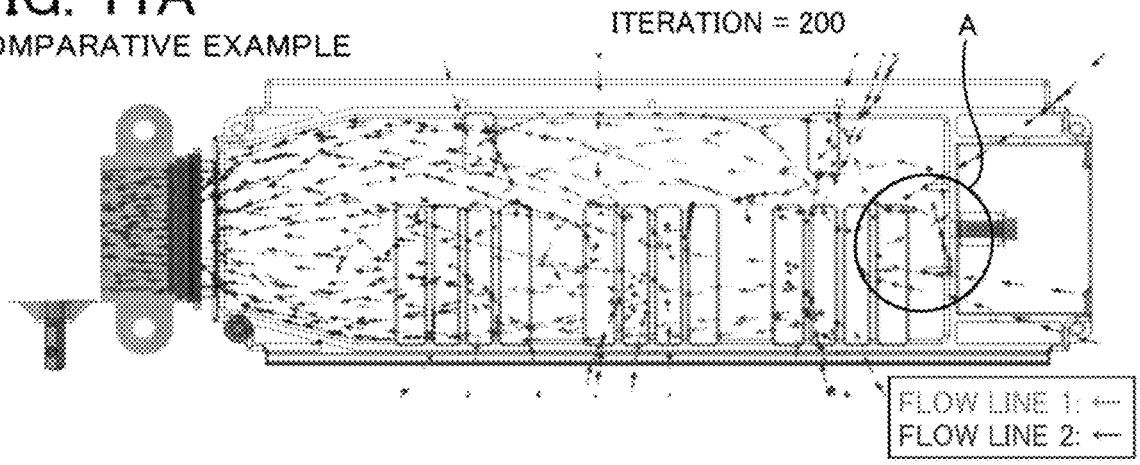
FIGS. 11A to 11C are diagrams of airflow in the duct according to the comparative example.
Figure 11B:
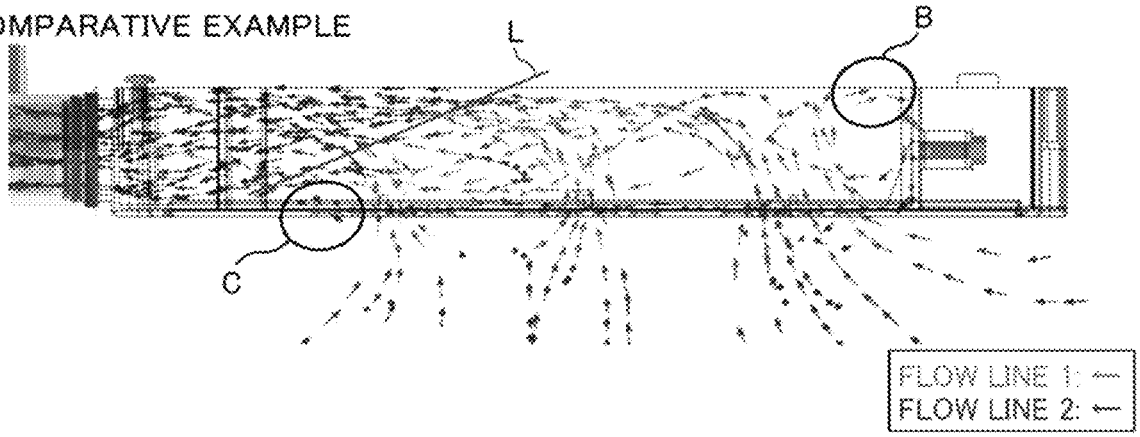
Figure 11C:
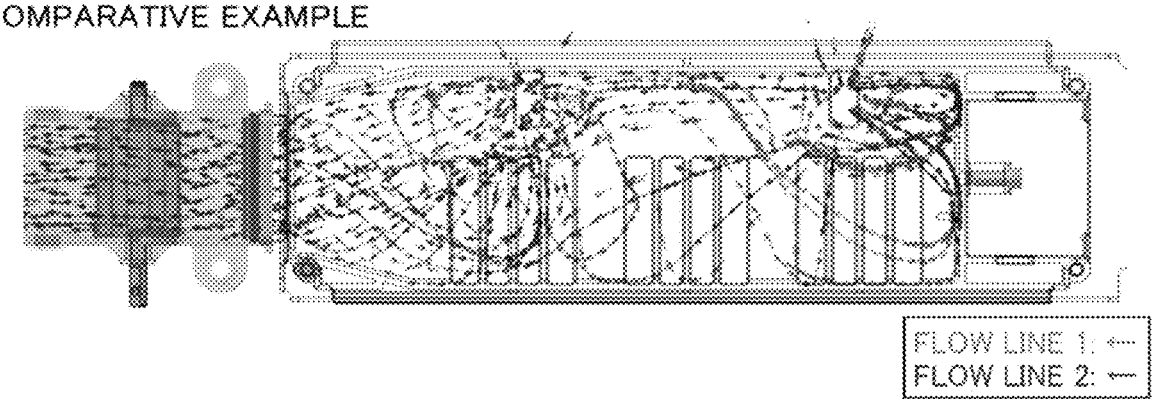

FIGS. 11A to 11C are diagrams of airflow in the duct 43 according to the comparative example. The velocity of the airflow at various points by computer simulation is indicated by arrows. Flow line 1 indicated by grey arrows means velocity slower than flow line 2 indicated by black arrows. FIG. 11A illustrates the airflow seen in the direction perpendicular to the lower wall 80, and FIG. 11B illustrates the airflow seen in the direction perpendicular to the long side wall 83*b*. In both FIGS. 11A and 11B, the suction openings 81 and the conveyance openings 82 are not covered with the sheet P. FIG. 11C illustrates the airflow seen in the direction perpendicular to the lower wall 80 when all of the suction openings 81 are covered with the sheet P and the conveyance openings 82 are not covered with the sheet P.

As illustrates in FIGS. 11A and 11B, air flowing through the suction openings 81 and the conveyance openings 82 flows toward the exhaust port 43*a* disposed at one end of the duct 43. The air that has flowed into the duct 43 from the suction openings 81 and the conveyance openings 82 spreads randomly into the internal space of the duct 43. Preferably, the air flows uniformly toward the exhaust port 43*a*, but the backflow of the air (vortex) is generated because the air flows into a place where air density is low. For example, in area A in FIG. 11A and area B in FIG. 11B, a part of the air flows toward the side opposite the exhaust port 43*a*. Thus, the vortex of the air interferes with the sucked air. As a result, an airflow in the direction in which air is ejected from the suction opening 81 is also generated as illustrated in area C in FIG. 11B.

Further, when the top sheet P of the bundle of sheets P is attracted to the suction belt 41 as illustrated in FIG. 3, the conveyance openings 82 remain open, and an airflow as illustrated in FIG. 11C is generated. Air continues to flow into the duct 43 from the conveyance openings 82 after the suction openings 81 attract the sheet P. Due to this air, a vortex of the air is generated in the duct 43, and a part of the air flows in the direction to peel the attracted sheet P from the suction belt 41. Therefore, a minute gap may be formed between the sheet P and the surface of the suction belt 41. Accordingly, the sheet P may not be firmly attracted to the suction belt 41, and the sheet P may be accidentally forwarded a slight distance.

Further, as illustrated in FIG. 11B, the airflow in the duct 43 becomes faster at the position closer to the exhaust port 43*a*. Line L in FIG. 11B indicates a boundary line of a region where the air flows at the high velocity that is equivalent to the velocity inside the exhaust port 43*a*. As described above, the airflow that is as fast as the airflow in the exhaust port 43*a* is limited to the vicinity of the exhaust port 43*a*, and the airflow becomes faster in the suction opening 81 corresponding to the suction belt 41 closer to the exhaust port 43*a* (i.e., in the order of the suction belts 41*c*, 41*b*, and 41*a* in the present embodiment). For this reason, the sheet P starts to be attracted on the side corresponding to the faster airflow sucking the sheet P. In this order, portions of the sheet P facing respective suction belts 41*c*, 41*b*, and 41*a* are sequentially attracted. The difference in the order to suck the portions of the sheet P may cause the sheet P to rotate and skew.

Figure 12:
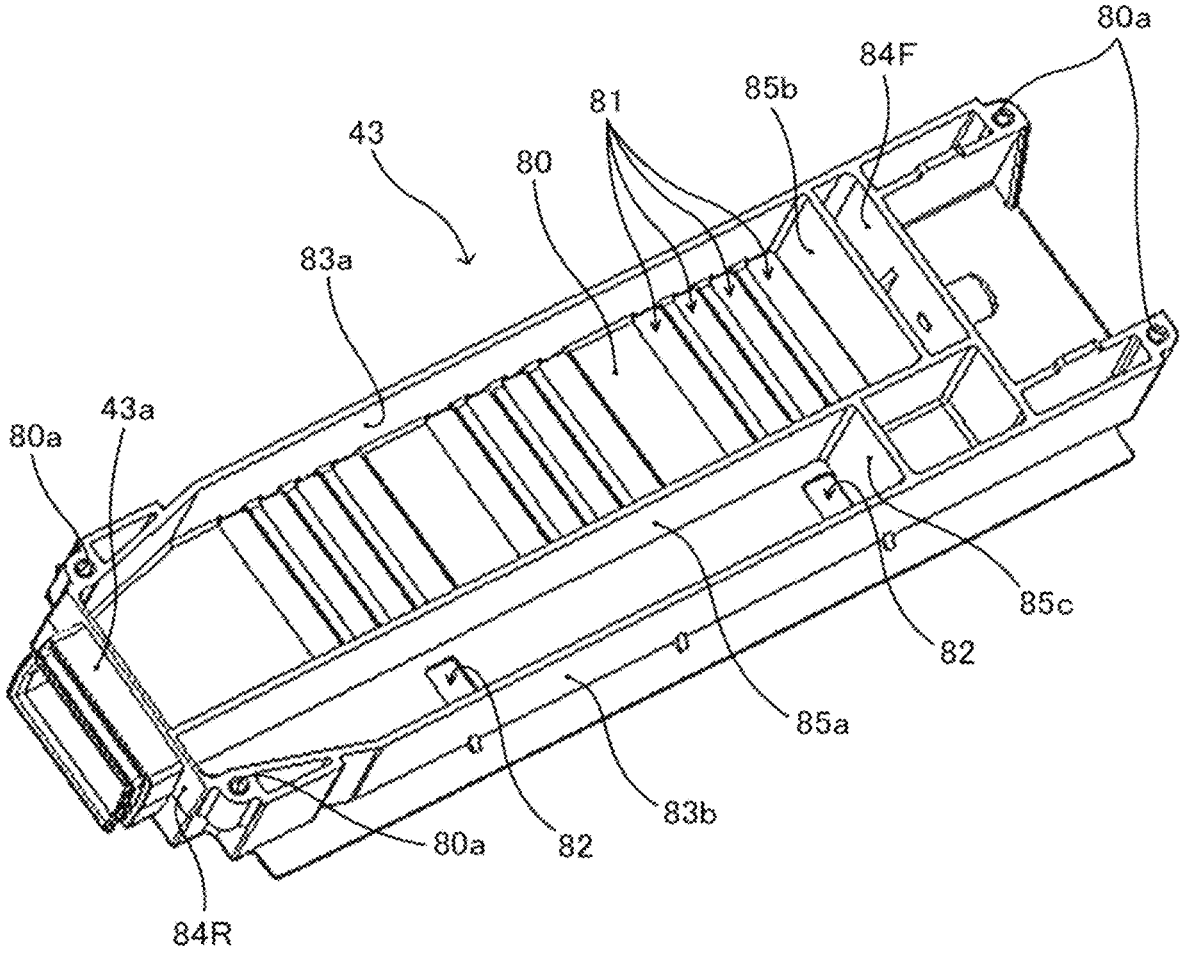
FIG. 12 is a perspective view of the duct whose inner surface of the lower wall is viewed according to an embodiment of the present disclosure.
Figure 13:
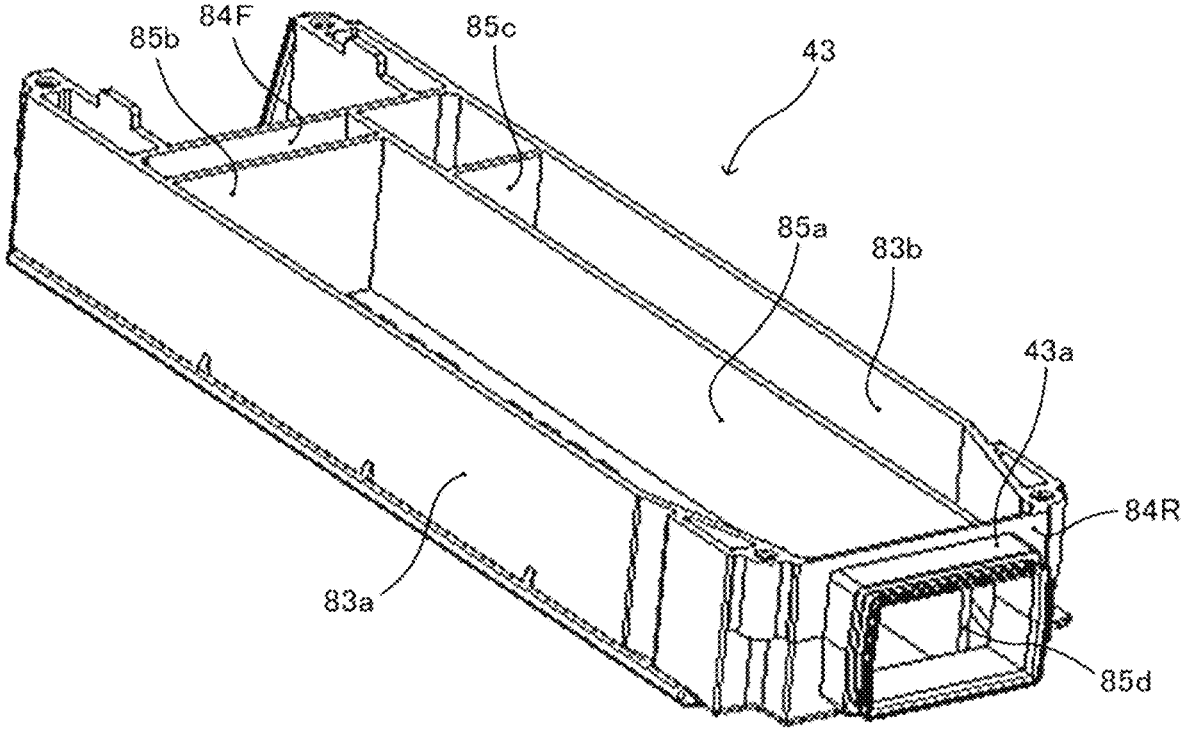
FIG. 13 is a perspective view of the duct according to an embodiment of the present disclosure as viewed from a different angle.

Therefore, among the various inconveniences described above, in order to eliminate the inconvenience that occurs when the suction openings 81 are covered, the duct 43 according to the present embodiment prevents the air that has flowed in through the conveyance openings 82 from flowing into the portion of the duct 43 on the side where the suction openings 81 are disposed. FIG. 12 is a perspective view of the duct 43 whose inner surface of the lower wall 80 can be seen according to the present embodiment. FIG. 13 is a perspective view of the duct 43 as viewed from a different angle. The duct 43 includes a partition 85*a* as a first rectifier extending in the width direction perpendicular to the conveyance direction by the suction belt 41. The partition 85*a* partitions the internal space in the duct 43 into an upstream compartment where the suction openings 81 are disposed and a downstream compartment where the conveyance openings 82 are disposed in the conveyance direction.

Further, in the example illustrated in FIGS. 12 and 13, a short side wall 85*b* is disposed at the position aligned with the edge of the suction opening 81 to partition the upstream compartment into a side where the exhaust port 43*a* is disposed and another side opposite the exhaust port 43*a*. Similarly, a short side wall 85*c* is disposed at the position aligned with the edge of the conveyance opening 82 to partition the downstream compartment into a side where the exhaust port 43*a* is disposed and another side opposite the exhaust port 43*a*. These configurations narrows a space where turbulence may occur.

In the duct 43 according to the present embodiment, the internal space is completely separated into the upstream compartment where the suction openings 81 are disposed and the downstream compartment where the conveyance openings 82 are disposed. Therefore, when the suction opening 81 is covered, the air that has flowed into the downstream compartment through the conveyance openings 82 is prevented from entering the upstream compartment where the suction openings 81 are disposed. As a result, a vortex of the air is not generated.

Figure 14:
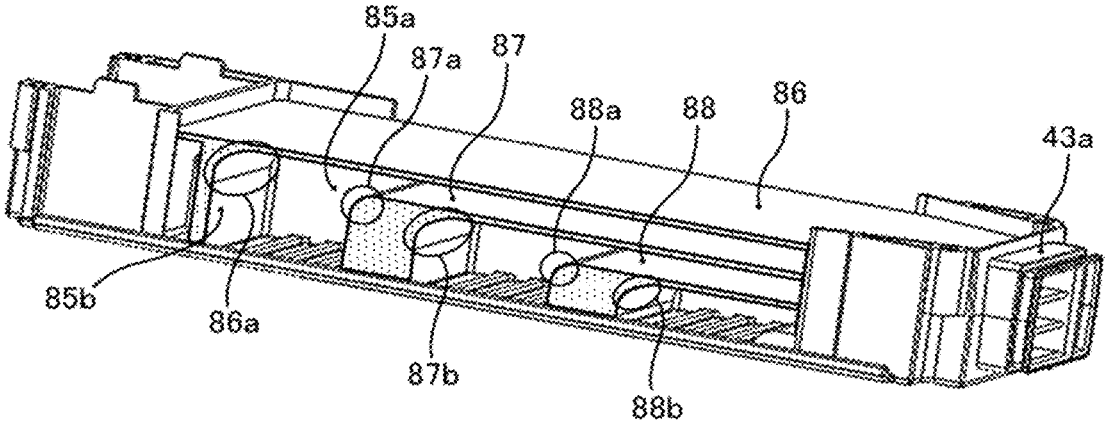
FIG. 14 is a perspective view of a duct according to a first variation.
Figure 15:
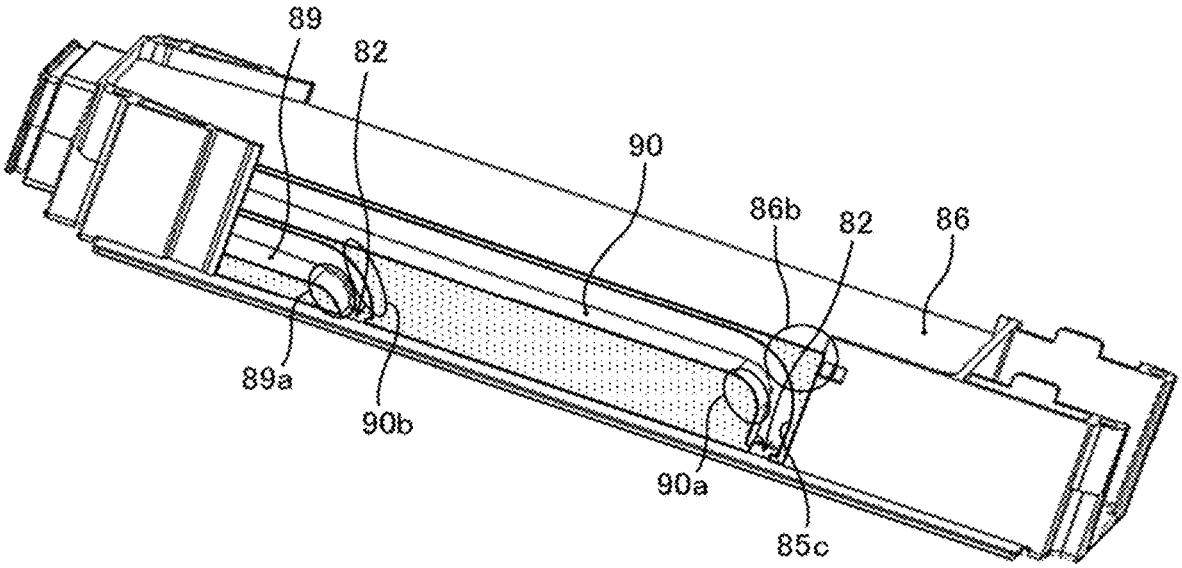
FIG. 15 is a perspective view of the duct according to the first variation as viewed from a different angle.
Figure 16:
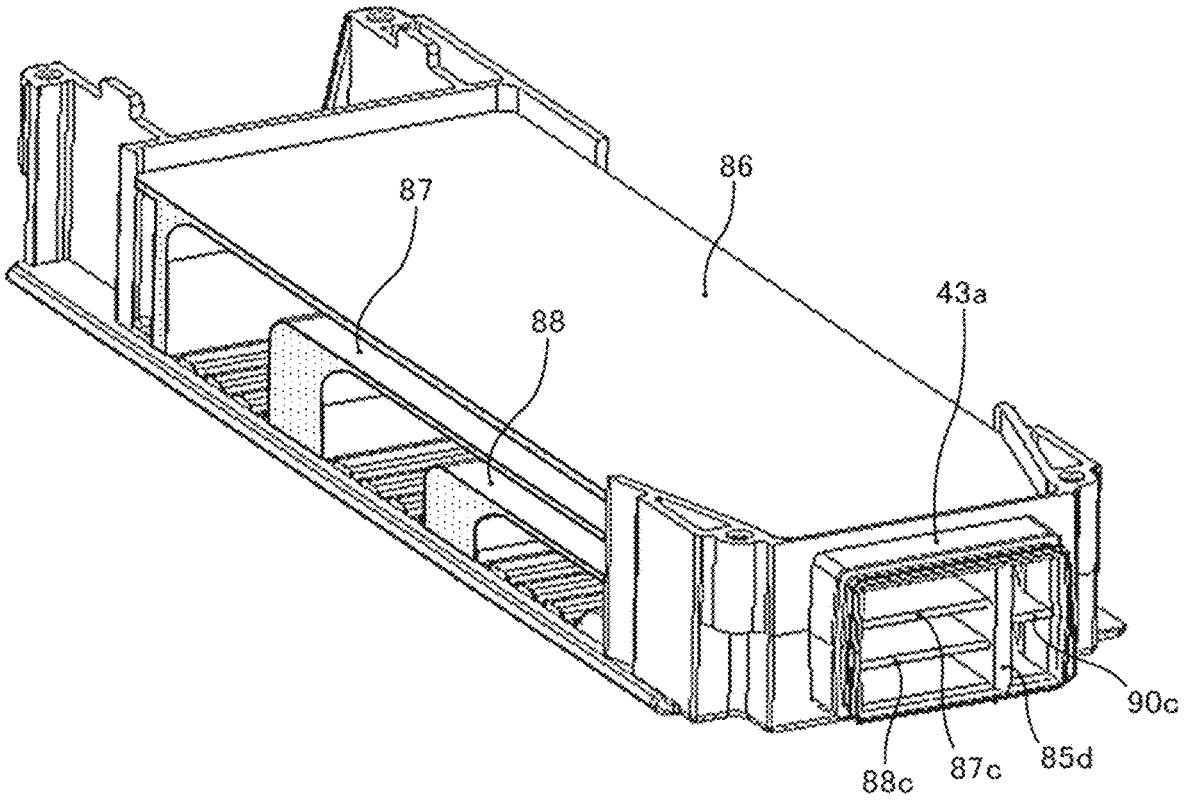
FIG. 16 is a perspective view of the duct according to the first variation as viewed from another different angle.

FIGS. 14 to 16 are perspective views of a duct 43 according to a variation (i.e., a first variation). In addition to the partition 85*a*, the duct 43 according to the first variation includes partitions 87 and 88 in the upstream compartment where the suction openings 81 are disposed. The partitions 87 and 88 partition the upstream compartment into three regions and reach the exhaust port 43*a*. The plurality of suction openings 81 is divided into three areas each having the four suction openings 81. With this configuration, air flows through three areas corresponding to the suction belts 41*a*, 41*b*, and 41*c* into the three regions of the upstream compartment, and the airflows in the three regions do not interfere with each other. The duct 43 further includes a partition 90 in the downstream compartment where the conveyance openings 82 are disposed. The partition 90 partitions the downstream compartment into two regions and reaches the exhaust port 43*a*. With this configuration, air flows through the two conveyance openings 82 into the two regions, and the airflows in the two regions do not interfere with each other. The partitions 87, 88, and 90 serves as second rectifiers as described later. As illustrated in FIG. 16, the partitions 85*a*, 87, 88, and 90 extend to the exhaust port 43*a*, and ends 85*d*, 87*c*, 88*c*, and 90*c* of the partitions 85*a*, 87, 88, and 90 are located at the opening of the exhaust port 43*a*.

In FIGS. 14 to 16, the long side walls 83*a* and 83*b* are omitted except for the portions corresponding to the partitions 87, 88, and 90 added in the first variation so that the interior of the duct 43 can be seen. The portions corresponding to the added partitions 87, 88, and 90 are shaded with halftone dots for the sake of understanding the shape. In the example illustrated in FIGS. 14 to 16, an upper wall 86 of the duct 43 is integrally formed together with the side walls 85*b* and 85*c*.

In FIG. 14, each of the two added partitions 87 and 88 includes a block-shaped portion and a flat plate portion. The block-shaped portion is disposed on the rib (i.e., a portion other than the suction openings 81) between the three areas each having the four suction openings 81 in the lower wall 80. The flat plate portion extends from the top of the block-shaped portion to the exhaust port 43*a*. An upper corner 87*a* and a lower corner 87*b* ranging between the block-shaped portion and the flat plate portion of the partition 87 have curvatures. Similarly, corners 88*a* and 88*b* of the other partition 88 have curvatures. In addition, in FIG. 14, a corner 86*a* ranging between the upper wall 86 and the side wall 85*b* has a curvature. As described above, the side wall 85*b* partitions the upstream compartment into the side where the exhaust port 43*a* is disposed and another side opposite the exhaust port 43*a*.

The portions forming the corners 86*a*, 87*b*, and 88*b* serve as the second rectifiers to rectify the direction of airflow. Air that flows through the suction openings 81 collides with the corners 86*a*, 87*b*, and 88*b* and turns toward the exhaust port 43*a* disposed at the one end of the duct 43. The corners 86*a*, 87*b*, and 88*b* have the same shape including the curvature. Further, the corners 87*a*, 88*a*, along which the air turned by the corners 86*a*, 87*b*, and 88*b* flows, have the same shape including the curvature. The corners 87*a* and 88*a* also serves as the second rectifiers.

Further, the areas of the three areas each having the four suction openings 81 are equal to each other. The cross-sectional areas of the internal spaces in an imaginary plane parallel to the suction port in the three regions from the suction port to a lowest point of the corners 86*a*, 87*a*, 87*b*, 88*a* or 88*b* along the flat face of the block-shaped portion are equal to the areas of the three areas, respectively. The cross-sectional areas are equal to each other between the three regions. In the vertical direction, the distance between the inner surface of the lower wall 80 of the duct 43 and the flat plate portion of the partition 88 on the low side, the distance between the flat plate portion of the partition 88 and the flat plate portion of the partition 87 on the high side, and the distance between the flat plate portion of the partition 87 and the inner surface of the upper wall 86 are equal to each other.

In FIG. 15, the added partition 90 includes a block-shaped portion and a flat plate portion. The block-shaped portion is disposed on the rib between the two conveyance openings 82. The flat plate portion extends from the top of the block-shaped portion to the exhaust port 43*a*. An upper corner 90*a* and a lower corner 90*b* ranging between the block-shaped portion and the flat plate portion of the partition 90 have curvatures. In addition, in FIG. 15, a corner 86*b* ranging between the upper wall 86 and the side wall 85*c* has a curvature. As described above, the side wall 85*c* partitions the downstream compartment into the side where the exhaust port 43*a* is disposed and another side opposite the exhaust port 43*a*. This curvature of the corner 86*b* is equal to the curvature of the corner 90*b*.

Further, a block portion 89 extends from the edge of the conveyance opening 82 illustrated on the left side in FIG. 15 to the exhaust port 43*a*. A corner 89*a* of the block portion 89 facing the corner 90*b* has the same curvature as the corner 90*a*. The distance between the upper surface of the block portion 89 and the lower surface of the flat plate portion of the partition 90 is equal to the distance between the upper surface of the block-shaped portion and the flat plate portion of the partition 90, and the lower surface of the upper wall 86. The portions forming the corners 86*b* and 90*b* serve as the second rectifiers to rectify the direction of airflow. Air that flows through the conveyance openings 82 collides with the corners 86*b* and 90*b* and turns toward the exhaust port 43*a*. The corners 90*a*, 89*a*, along which the air turned by the corners 86*b* and 90*b* flows, have the same shape including the curvature. The corners 90*a* and 89*a* also serves as the second rectifiers.

According to the first variation, air flows through the three areas each having the four suction openings 81 into the three regions, and the airflows in the three regions do not interfere with each other from the suction openings 81 to the exhaust port 43*a*. Further, air flows through the two conveyance openings 82 into the two regions, and the airflows in the two regions do not interfere with each other from the conveyance openings 82 to the exhaust port 43*a*. Therefore, turbulence due to the interference of the airflows does not occur. In addition, since the airflow does not become faster at the position closer to the exhaust port 43*a*, the inconvenience is prevented that portions of the sheet P facing respective suction belts 41*c*, 41*b*, and 41*a* are sequentially attracted. Further, since the shapes including the curvature are the same each other, the loss factors of the airflows are the same. As a result, air that flows into the duct 43 flows at an almost uniform velocity in the duct 43. Since the cross-sectional areas and the distances perpendicular to the airflows in the respective regions are equal to each other, the velocities of the airflows are close to each other between the respective regions.

Figure 17A:
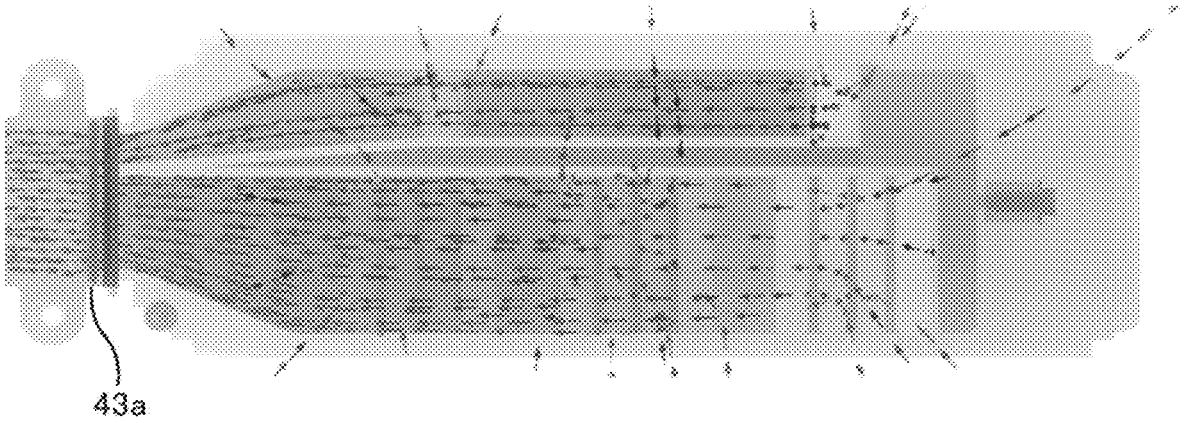
FIGS. 17A and 17B are diagrams of airflow in the duct according to the first variation.
Figure 17B:
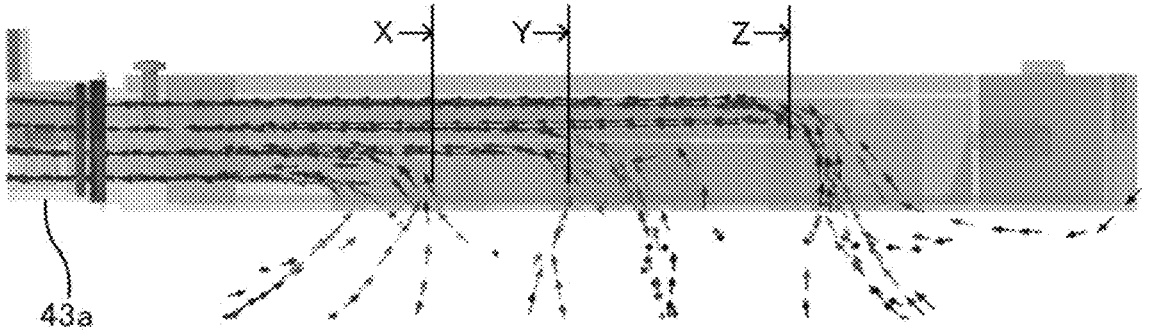

FIGS. 17A and 17B are diagrams of airflow in the duct 43 according to the first variation. The velocity of the airflow at various points by computer simulation is indicated by arrows. FIG. 17A illustrates the airflow seen in the direction perpendicular to the lower wall 80, and FIG. 17B illustrates the airflow seen in the direction perpendicular to the long side wall 83*b*. In both FIGS. 17A and 17B, the suction openings 81 and the conveyance openings 82 are not covered with the sheet P. As compared with FIG. 11A, in FIG. 17A, the partition 85*a* partitions the internal space in the duct 43 into the upstream compartment where the suction openings 81 are disposed and the downstream compartment where the conveyance openings 82 are disposed. Accordingly, air does not flow across the upstream compartment and the downstream compartment. Therefore, when the sheet P has been attracted to the suction belt 41 and only the suction openings 81 are covered with the sheet P, air flows into the downstream compartment through the conveyance openings 82. However, the airflow in the downstream compartment does not affect the airflow in the upstream compartment where the suction openings 81 are disposed.

Moreover, as illustrated in FIG. 17B, since the interference of the airflows between the three regions corresponding the three areas each having the four suction openings 81 is prevented, air flows at the same velocity in the suction openings 81 of each of the three areas. Leader lines X, Y, and Z indicate boundaries of regions in which the airflow at substantially the same high velocity as in the exhaust port 43*a* is generated in the airflow path of the three regions between the exhaust port 43*a* and the three areas (i.e., the left, middle, and right areas in FIG. 17B). Thus, the airflow at high velocity can be generated from the exhaust port 43*a* to the position facing each of the three areas in the horizontal direction in FIG. 17B. As a result, the inconvenience is prevented that portions of the sheet P facing respective suction belts 41*c*, 41*b*, and 41*a* are sequentially attracted.

Figure 18:
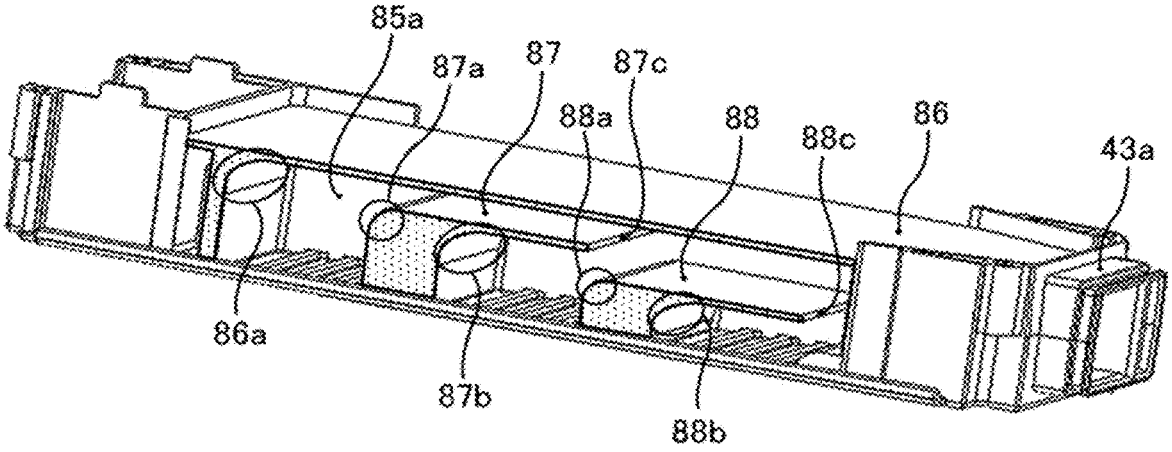
FIG. 18 is a perspective view of a duct according to a second variation.
Figure 19:
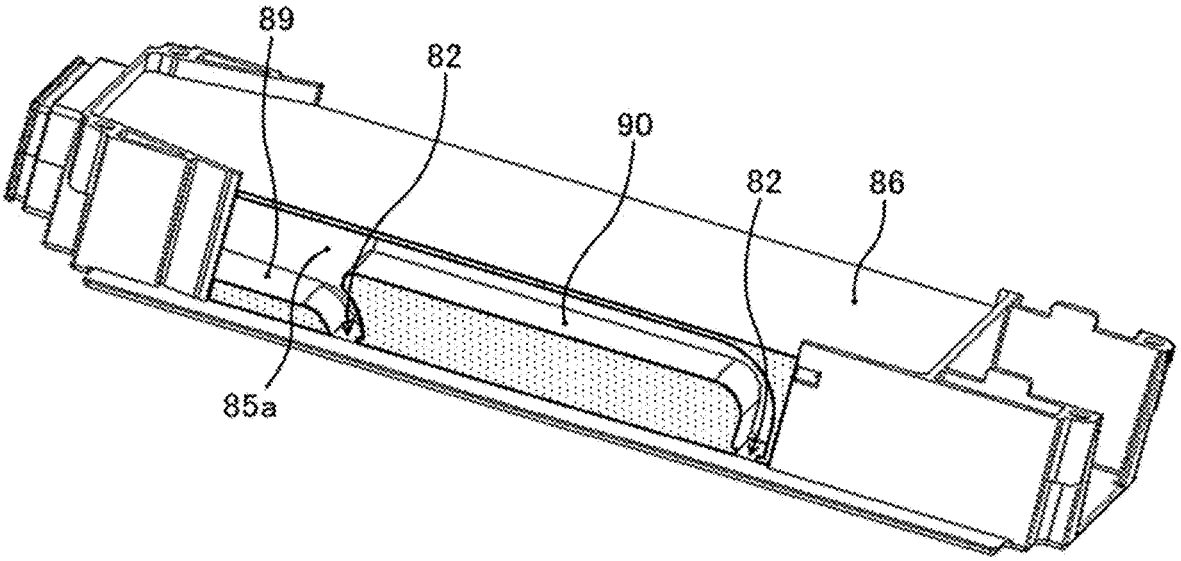
FIG. 19 is a perspective view of the duct according to the second variation as viewed from a different angle.

FIGS. 18 to 19 are perspective views of a duct 43 according to another variation (i.e., a second variation). FIG. 18 is a perspective view corresponding to FIG. 14 in the first variation, and FIG. 19 is a perspective view corresponding to FIG. 15 in the first variation. The second variation is the same as the first variation except that the flat plate portions of the partitions 87, 88, and 90 are shortened or eliminated.

In FIG. 18, the partitions 87 and 88 are disposed in the upstream compartment where the suction openings 81 are disposed, and the flat plate portions of the partitions 87 and 88 does not reach the exhaust port 43*a*. Specifically, the second partition 87 from the exhaust port 43*a* extends to the position above the edge of the book-shaped portion of the first partition 88 adjacent to the exhaust port 43*a* (the edge on the side opposite the exhaust port 43*a*). The flat plate portion of the first partition 88 has the same length as the flat plate portion of the second partition 87.

In FIG. 19, the partition 90 is disposed in the downstream compartment where the conveyance openings 82 are disposed, and the flat plate portion of the partition 90 is eliminated except for a portion forming a corner ranging between the block-shaped portion and the flat plate portion. The second variation can also reduce the difference in airflow velocity between the three areas each having the four suction openings 81.

Figure 20A:
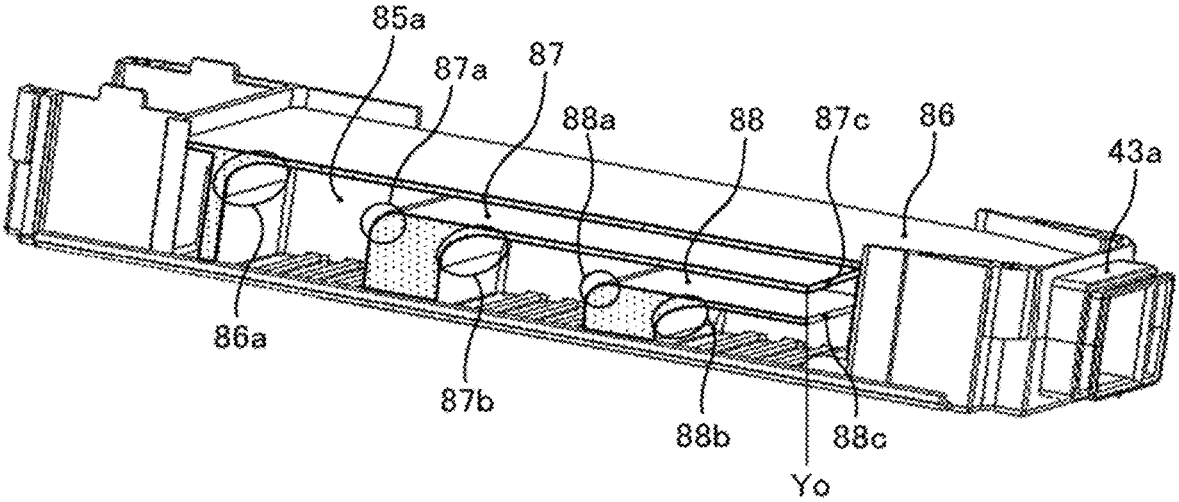
FIGS. 20A and 20B are a perspective view of a duct according to a third variation.
Figure 20B:
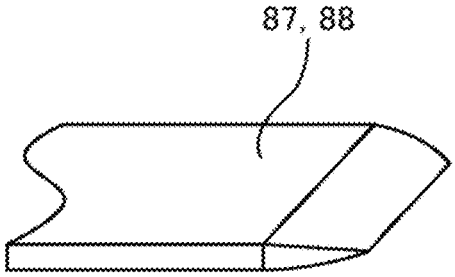

FIGS. 20A and 20B are perspective views of a duct 43 according to yet another variation (i.e., a third variation). FIG. 20A is the perspective view corresponding to FIG. 14 in the first variation and FIG. 18 in the second variation. In the third variation, the flat plate portion of the second partition 87 in the second variation is extended. The position of the end portion 87*c* of the flat plate portion of the partition 87 matches the position Yo of the end portion 88*c* of the flat plate portion of the first partition 88 in the longitudinal direction of the duct 43.

Note that the partitions 87 and 88 are required to rectify the direction of airflow flowing through the suction port toward the exhaust port 43*a*. However, it is unnecessary that the positions of the end portions 87*c* and 88*c* completely aligned with the position Yo. The position of the end portion 87*c* can be any position from the edge of the block portion of the partition 88 on the opposite side of the exhaust port 43*a* toward the exhaust port 43*a*, but the partition 87 does not reach the exhaust port 43*a* unlike the partition 87 illustrated in FIG. 14. That is, at least a part of the partition 87 overlaps with the partition 88 in the longitudinal direction of the duct 43.

In the partitions 87 and 88, the shape of the end portions 87*c* and 88*c* (see FIG. 20A) of the flat plate portions can be tapered as illustrated in FIG. 20B. Further, the end portions 87*c* and 88*c* can be rounded and have an arc shape. These shapes are applicable to other variations described above. These shapes make the airflow in the duct 43 smooth. The partitions 87, 88, and 90 are made of, for example, resin such as acrylonitrile butadiene styrene (ABS), polyoxymethylene (POM), or nylon, or metal such as molybdenum (Mo). When the partitions 87, 88, and 90 are made of ABS, POM, or nylon, surface layers may be formed on the surfaces of the partitions 87 and 88. In addition to the surfaces of the partitions 87 and 88, the surface layer may be formed on inner surfaces of all walls (e.g., the upper wall 86, the lower wall 80, the side walls 83*a*, 83*b*, 85*b*, and 85*c*, and the partition 85*a*). The surfaces made of ABS, POM, or nylon can be coated with metal such as molybdenum or aluminum (Al) by plating treatment, and further, the surface of aluminum can be treated by alumite treatment, in order to smooth the surfaces and reduce air resistance while protecting the surfaces of the partitions 87, 88, and 90 and the walls.

Figure 21A:
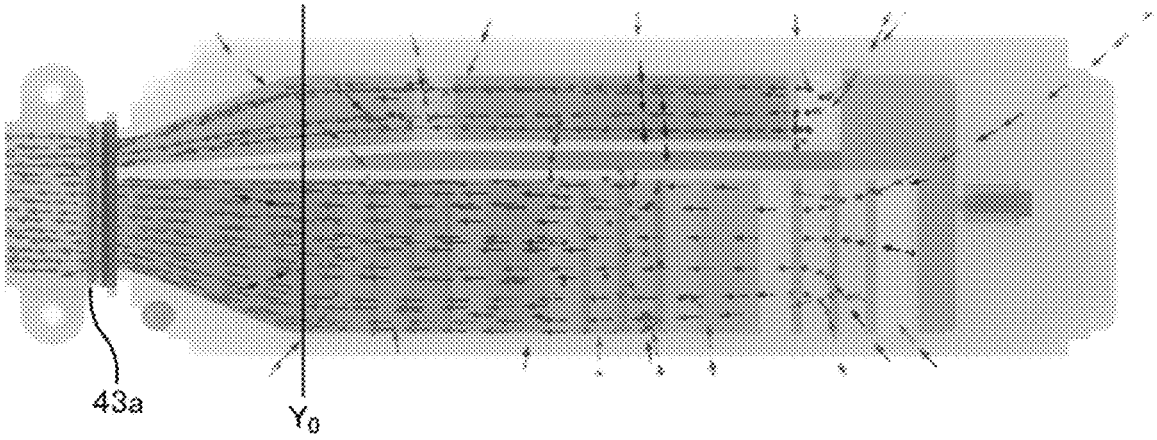
FIGS. 21A and 21B are diagrams of airflow illustrating a position Yo of an end portion of a partition of the duct according to the third variation.
Figure 21B:
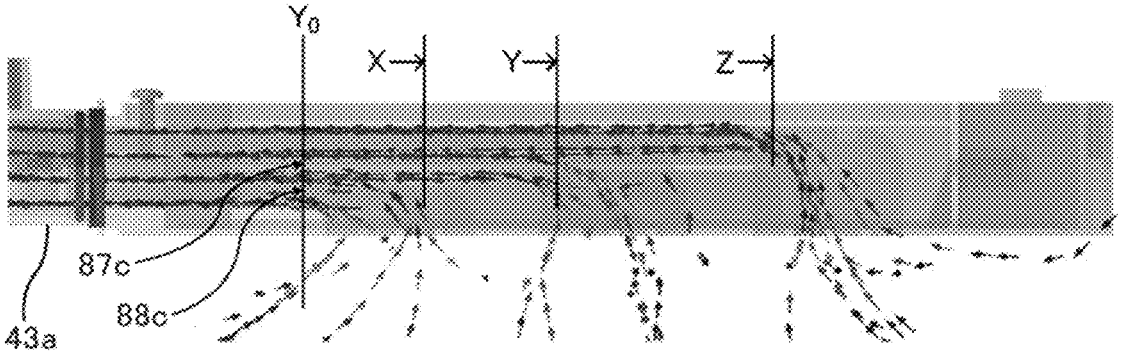

The position Yo of each the end portion 87*c* and 88*c* in the longitudinal direction of the duct 43 is determined as follows. In FIGS. 21A and 21B, the position Yo of the end portions 87*c* and 88*c* is illustrated using the diagrams of airflow in FIGS. 17A and 17B. The velocity of the airflows that flow from the three areas each having the four suction openings 81 become constant at the position Yo on the side of the exhaust port 43*a*. The flat plate portions of the partition 87 and 88 do not exist from the position Yo to the exhaust port 43*a*. Therefore, the cross-section of the duct 43 through which air flows is effectively enlarged. As a result, the airflow is improved.

Figure 22:
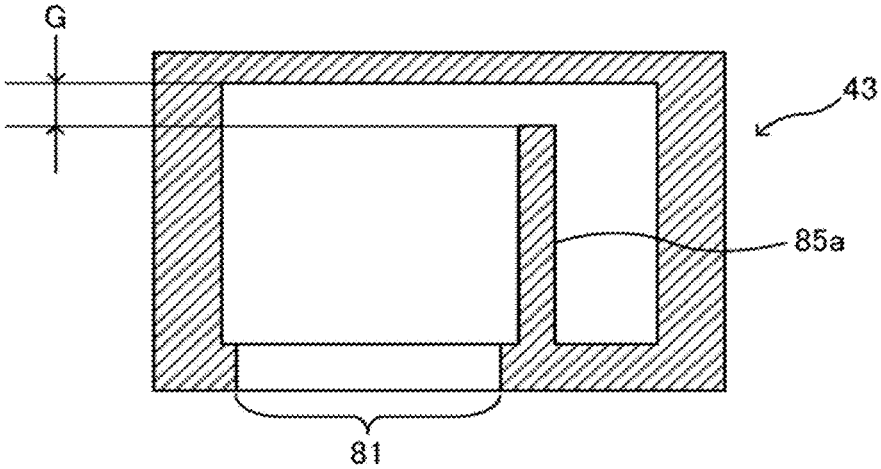
FIG. 22 is a cross-sectional view of a duct according to another variation.

In the above-described embodiments, the partition 85*a* between the upstream compartment where the suction openings 81 are disposed and the downstream compartment where the conveyance openings 82 are disposed completely partitions the internal space between the inner surface of the lower wall 80 and the lower surface of the upper wall 86 of the duct 43. Alternatively, the partition 85*a* can partially partition the internal space with a gap G as illustrated in FIG. 22. That is, when the internal space is partially comparted, the effects described in the above embodiments can be obtained.

According to the above-described embodiments, the following effects can be obtained.

1. Since airflows for sucking the sheet and for conveying the sheet is separated, the respective airflows do not interfere with each other, thereby improving the performance of conveying or feeding the sheet.

2. Since airflow in the duct is uniform, the airflow without loss of velocity can be provided.

3. Since portions of the duct into which air flows have the same shape, the loss factor of the airflow in the duct can be the same, thereby uniforming the airflow.

Above-described effects lead to the following advantages. That is, the suction force is increased, and thick paper, heavy paper can be conveyed or fed. Further, sheets other than paper, such as film, plastic, and sheet metal, can be conveyed or fed. Further, since the air flowing into the duct through the suction port is uniform, skew of the sheet can be prevented, thereby conveying the sheet with high accuracy.

Each part of the duct can be fabricated, for example, by three-dimensional (3D) printers. The duct can be manufactured by molding as a single piece or by assembling separated parts.

Above-described embodiments are examples. In the above-described embodiments, the endless belt 41 has the through holes, but an endless belt without through holes can be used. In this case, the endless belt is arranged so as to expose the suction port of the duct. Further, the belt conveyance device is not limited to the sheet feeding device 3, but can be applied to, for example, general belt devices using a suction belt, such as a sheet conveyance device.

As described above, according to the present disclosure, suction efficiency of the duct can be improved.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A belt conveyance device comprising:

an endless belt;

a duct having a suction port, the duct surrounded by an inner circumferential surface of the endless belt; and a rectifier inside the duct, extending in a width direction of the endless belt perpendicular to a direction of conveyance by the endless belt, wherein the rectifier partitions an internal space in the duct into an upstream compartment and a downstream compartment in the direction of conveyance, the belt conveyance device further comprising another rectifier in at least one of the upstream compartment and the downstream compartment to rectify a direction of airflow flowing through the suction port toward one end of the duct in the width direction, wherein said another rectifier includes a plurality of rectifiers, wherein at least one of the plurality of rectifiers partitions the at least one of the upstream compartment and the downstream compartment into a plurality of regions, wherein each of the plurality of rectifiers includes a corner having a curvature to rectify the direction of the airflow flowing through the suction port toward the one end of the duct in the width direction, and wherein the corner of each of the plurality of rectifiers has a same shape.

2. The belt conveyance device according to claim 1, wherein cross-sectional areas of the plurality of regions from the suction port to the corner in an imaginary plane parallel to the suction port are equal to each other.

3. The belt conveyance device according to claim 1, wherein the endless belt is divided into a plurality of belts in the width direction, and wherein the plurality of belts faces the plurality of regions, respectively.

4. The belt conveyance device according to claim 1, wherein the duct includes a coupling portion at the one end of the duct in the width direction to connect an interior and an outside of the duct, and wherein the rectifier reaches the coupling portion.

5. The belt conveyance device according to claim 1, wherein the duct includes a coupling portion at the one end of the duct in the width direction to connect an interior and an outside of the duct, and wherein said another rectifier reaches the coupling portion.

6. A sheet feeding device comprising:

a sheet stacker on which a bundle of sheets is stacked;

a blower configured to blow air onto a top sheet of the bundle of sheets to levitate the top sheet; and the belt conveyance device according to claim 1, configured to feed the top sheet levitated by the blower.

7. The sheet feeding device according to claim 6, further comprising a sheet conveyance path through which the top sheet is conveyed, the sheet conveyance path downstream from the bundle of sheets, wherein the rectifier partitions an internal space in the duct into an upstream compartment and a downstream compartment in the direction of conveyance, wherein the suction port includes a plurality of suction openings in an exterior wall of the duct, wherein at least one of the plurality of suction openings in the upstream compartment faces the bundle of sheets, and wherein the rest of the plurality of suction openings in the downstream compartment face the sheet conveyance path.

8. An image forming system comprising:

an image forming apparatus including an image forming unit configured to form an image on a sheet; and the sheet feeding device according to claim 6, configured to feed the sheet to the image forming apparatus.

9. An image forming apparatus comprising:

an image forming unit configured to form an image on a sheet; and the belt conveyance device according to claim 1, configured to convey the sheet in the image forming apparatus.

10. A belt conveyance device comprising:

an endless belt;

a duct having a suction port, the duct surrounded by an inner circumferential surface of the endless belt; and a rectifier inside the duct, extending in a width direction of the endless belt perpendicular to a direction of conveyance by the endless belt, the rectifier including a corner having a curvature to rectify the direction of airflow flowing through the suction port toward one end of the duct in the width direction.

11. The belt conveyance device according to claim 10, further comprising:

another rectifier inside the duct, extending in the width direction of the endless belt perpendicular to the direction of conveyance by the endless belt, the another rectifier including a corner having a curvature to rectify the direction of the airflow flowing through the suction port toward the one end of the duct in the width direction, wherein the corner of each of the rectifiers has a same shape.

* * * * *